US005228143A

United States Patent [19]

Marchello

[11] Patent Number: 5,228,143

[45] Date of Patent: Jul. 20, 1993

[54] ATHLETIC EAR GUARD ASSEMBLY WITH REMOVABLE EAR PAD

[75] Inventor: John L. Marchello, Ann Arbor, Mich.

[73] Assignee: Danmar Products, Inc., Ann Arbor, Mich.

[21] Appl. No.: 772,141

[22] Filed: Oct. 7, 1991

[51] Int. Cl.[5] ..... A63B 71/10

[52] U.S. Cl. ..... 2/425; 2/209

[58] Field of Search ..... 2/209, 410, 411, 412, 2/414, 417, 418, 419, 420, 422, 423, 425, 6

[56] References Cited

U.S. PATENT DOCUMENTS

| | | | |
|---|---|---|---|
| 3,588,914 | 6/1971 | Ihnat | 2/425 |
| 3,596,288 | 8/1971 | Marchello | 2/425 |
| 3,661,225 | 5/1972 | Anderson | 2/6 |
| 4,551,861 | 11/1985 | Marchello | 2/425 |
| 4,710,985 | 12/1987 | Dubner | 2/425 |

*Primary Examiner*—Clifford D. Crowder
*Assistant Examiner*—Diana L. Biefeld
*Attorney, Agent, or Firm*—Harness, Dickey & Pierce

[57] ABSTRACT

Athletic ear guard assembly is disclosed having a removable inner ear pad that enables the ear pad to be removed by hand for a thorough cleaning of both the ear pad and the concave cup section into which the ear pad is mounted. The cup section is part of a side panel molded with a plurality of extending legs that are deflected to form the concave cup section. Likewise, the inner ear pad is also molded flat to provide ease in molding the components of the ear guard assembly. Thorough cleaning of the ear guard assembly is facilitated by easy hand removal of the ear pad to prevent the spread of bacteria and viruses among wrestling opponents.

17 Claims, 2 Drawing Sheets

ATHLETIC EAR GUARD ASSEMBLY WITH REMOVABLE EAR PAD

BACKGROUND AND SUMMARY OF THE INVENTION

The present invention relates to an athletic ear guard assembly such as that worn by a wrestler and in particular to an ear guard assembly having removable ear pads to facilitate a thorough cleaning of the ear guard assembly.

During a wresting match, the opposing wrestlers are in close bodily contact with one another as well as in contact with the wrestling mat. As a result, it is possible that bacteria and or viruses carried on the skin or clothing of one wrestler can be transferred either directly to an opposing wrestler or can be transferred to the mat where it can be picked up by a subsequent wrestler. Such a transfer of bacteria or viruses is most likely with respect to diseases involving open wounds or sores such as cold sores. Of recent concern is the transmission of herpes simplex I between wrestling opponents. To help prevent the transmission of contagious diseases, increasing attention has been given to hygiene of wrestlers. It is recommended that wrestlers shower both before and after practice and that clean clothing be issued before each practice.

Wrestlers at virtually all levels of competition are required to wear protective head gear that covers the wrester's ears to prevent abrasion injuries to the ears. During use, the head gear collects perspiration and, by virtue of contact with the opponent and the wrestling mat, the head gear can collect bacteria and viruses. The perspiration provides an environment conducive for the growth of the bacteria or virus. Typical wrestling head gear has been constructed in a manner that creates numerous crevices for harboring perspiration and bacteria or viruses, making thorough cleaning and drying of the head gear relatively difficult.

Accordingly, it is an object of the present invention to improve the hygiene of wrestlers by providing head gear that can be easily cleaned to thoroughly remove all perspiration, bacteria, viruses etc., that are collected during a wrestling match.

It is a feature of the present invention to construct the head gear with a pair of concave cup sections for placement over the wearer's ears. Each cup section has a removable inner ear pad for direct contact with the wearer's ear. The inner ear pad is removable from the cup section by hand, enabling both the ear pads and the cup sections to be thoroughly washed, cleaned and dried.

It is a further feature of the present invention that both the inner ear pads and the concave cup sections are manufactured as flat molded parts that are later contoured into a concave shape. The flat molding simplifies the manufacturing process and facilitates printing of graphics to the outer side of the cup sections for team logos, etc.

Further objects, features and advantages of the invention will become apparent from a consideration of the following description and the appended claims when taken in connection with the accompanying drawings.

DETAILED DESCRIPTION OF THE INVENTION

Figure 1:
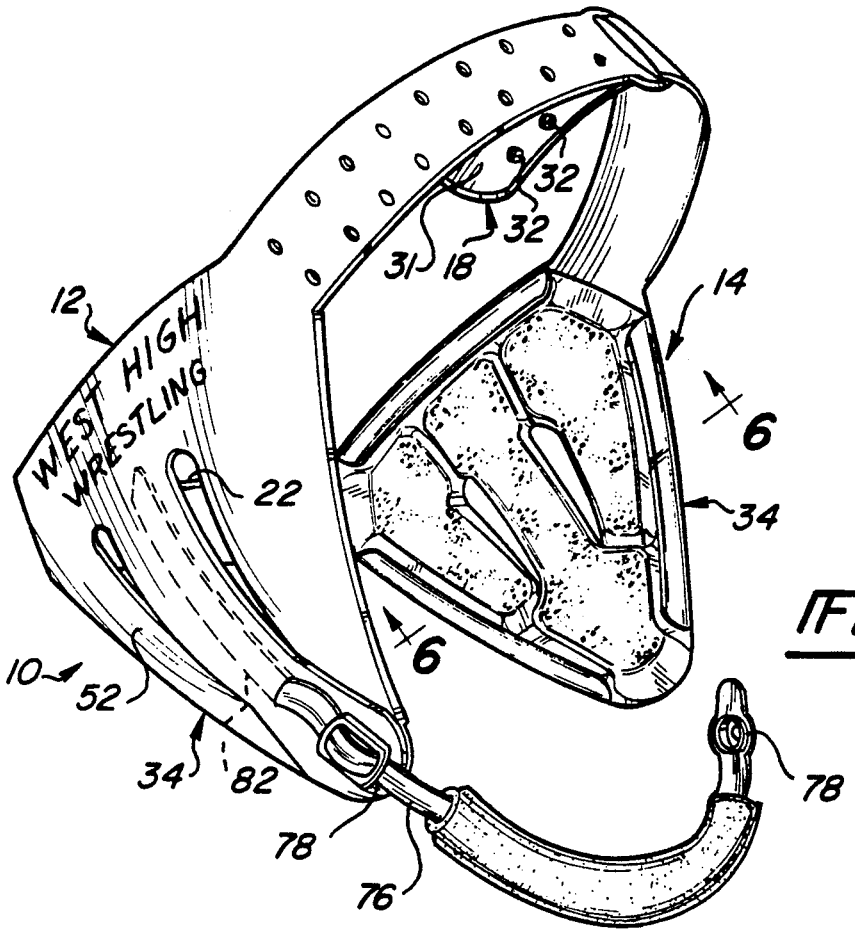
FIG. 1 is a perspective view of the assembled head gear of the present invention.
Figure 2:
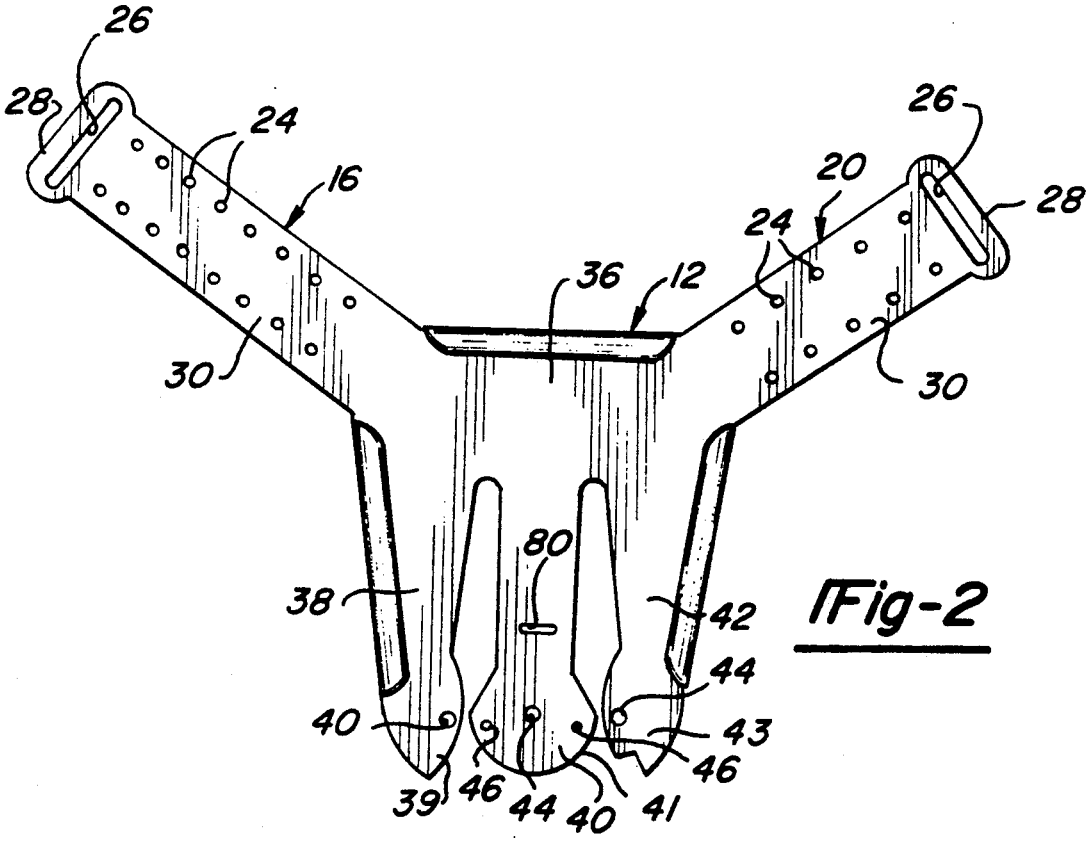
FIG. 2 is an elevational view of one side panel of the head gear of the present invention shown as a flat molding.

The athletic ear guard of the present invention is shown in FIG. 1 and designated generally at lo. Ear Guard 10 is assembled from a pair of side panels 12 and 14 with side panel 12 being the right side panel and side panel 14 being the left side panel. The side panels are plastic injection molded in a substantially flat sheet form as shown in FIG. 2 with the right side panel 12. The left and right side panels are molded with integral upper straps 16 and 18 respectively and rear straps 20 and 22 respectively. The straps 16 and 20 of the right side panel are formed with a plurality of regularly spaced holes 24 and with an elongated through slot 26 at the ends of the straps. The slots 26 extend transversely to the length of the straps in the enlarged end portions 28. The end portions are enlarged in width so that the slots 26 are longer than the width of the main portion 30 of the straps 16 and 20.

The two side panels are assembled together by feeding the straps 18 and 22 of the left side panel through the slots 26 in the straps of the right side panel. The straps 18 and 22 of the left side panel are each equipped with four raised mounting studs 32 that are spaced to snap into the holes 24 of straps 16 and 20. The straps 18 and 22 are fed through the slots 26 in an outside to inside manner such that the surface 31 of the straps 18 and 22, with the raised studs 32, faces the straps 16 and 20. This enables the studs to be snap-fit into the corresponding holes 24. The size of the ear guard assembly is adjusted by appropriate selection of the holes into which the mounting studs are inserted.

Figure 3:
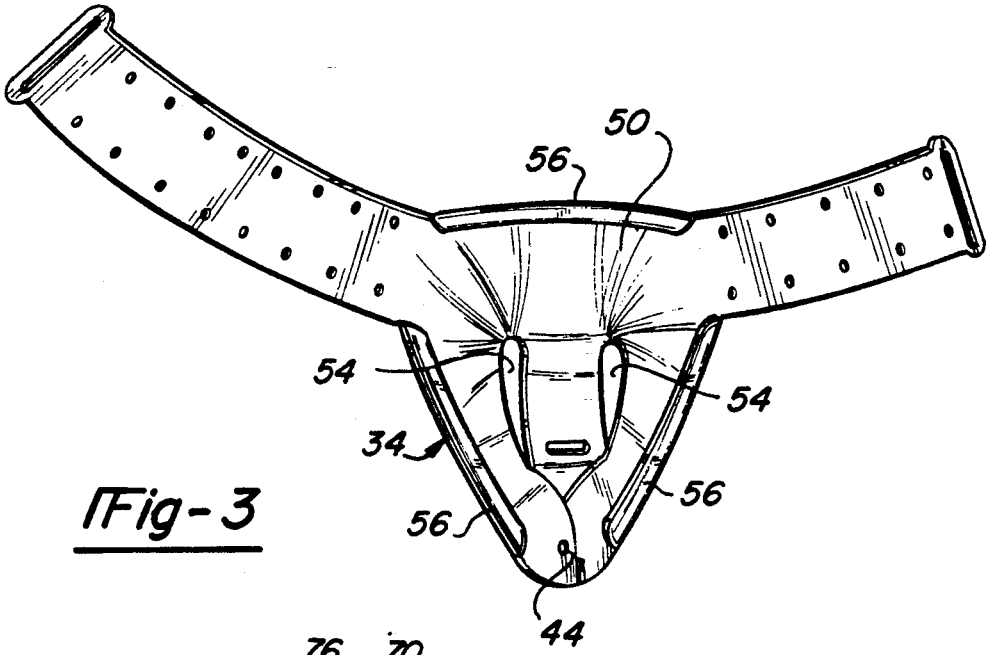
FIG. 3 is an elevational view of the side panel shown in FIG. 2 after contouring to form a cup section.
Figure 4:
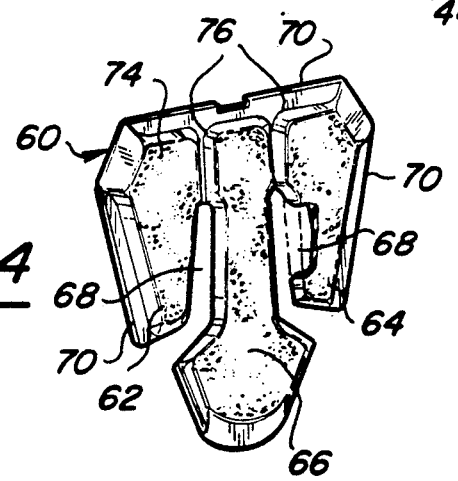
FIG. 4 is a perspective view of an inner ear pad of the present invention shown as a flat molding.

A cup section 34 is formed by each of the side panels to cover the wearer's ears. The cup portion is formed by a main panel 36 and three legs 38, 40 and 42 extending from the main panel. The legs are spaced from one another and extend in the same direction from the main panel. To form the cup section, the legs are deflected so the distal end 39 of outer leg 38 and the distal end 43 of outer leg 42 overlay the distal end of the center leg 40 as shown in FIG. 3. The holes 44 at the distal end of each leg are aligned with one another forming a passage through the three legs once overlaid. The ends of the legs overlay one another by bending of the outer legs which causes the center leg as well as the main panel 36 to bend, forming the triangularly shaped cup section 34, shown in FIG. 3.

To aid in assembly, the distal end 41 of the center leg 40 is formed with two smaller holes 46 while the outer surface of the distal ends 39 and 43 of the other legs are each formed with a mounting stud 32 (not shown) for insertion into the holes 46. This holds the legs in position while a rivet 48 (shown in FIG. 5) is inserted through the now aligned holes 44. The cup section 34 has a concave inner surface 50 shown in FIG. 3 forming a concave cavity and a generally convex outer surface 52 shown in FIG. 1. The spaces between the legs 40 and 42 form vent slots 54 in the cup sections 34. At the periphery of the cup sections 34, along the three sides of the triangularly shaped cupped sections, a flange 56 is formed on the interior or concave side forming a generally U-shaped channel 58 best shown in FIG. 6.

Figure 5:
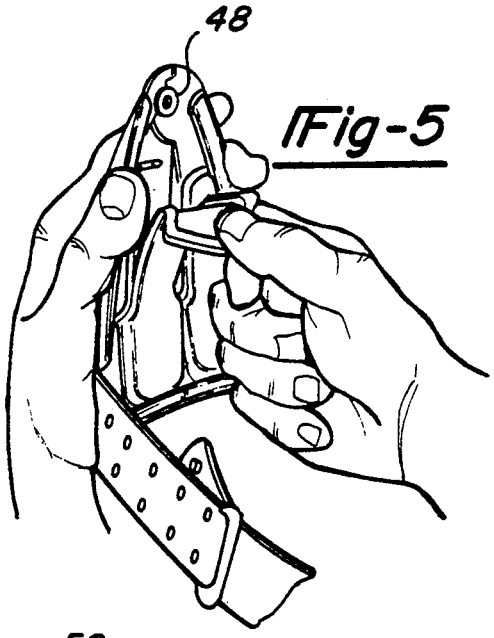
FIG. 5 is a perspective view showing the inner ear pad being removed by hand from the cup section.

An inner ear pad 60 is mounted in the cup on the concave side of the cup section 34 for contact with the wearer's ear. The inner ear pad 60 is molded flat of a soft, resilient, vinyl/rubber compound. The ear pad is in a flat triangulated shape with two sides 62 and 64 in an open appendage form and separated from the center portion 66 by spaces 68. Inner ear pad 60 is easily deformable or contoured into a concave shape to be mounted into the cup section 34 as shown in FIG. 1. The sides of the inner ear pads are formed with mounting flanges 70 for insertion into the U-shaped channels 58 at the periphery of the cup sections. The flanges thus retain the inner ear pads within the cup sections without the use of additional fasteners and in a manner that enables the inner ear pads to be removed and installed by hand as shown in FIG. 5. When installed, the spaces 68 between the legs of the inner ear pads align with the vent slots 54 in the cup sections to provide ventilation and to aid in hearing by the wearer.

Figure 6:
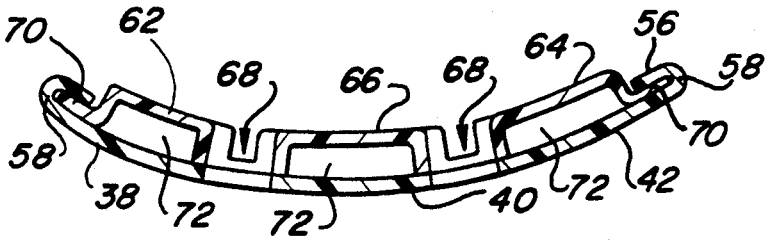
FIG. 6 is a sectional view of the cup section and inner ear pad as seen from substantially the line 6—6 of FIG. 1.

The sides 62 and 64 of the inner ear pads and the center portion 66 are formed so as to create hollow chambers 72 between the inner ear pad and the cup section as shown in FIG. 6. During an impact, the inner ear pad will flex to absorb a portion of the impact energy, thus protecting the wearer's ears. The inner surface 74 of the inner ear pads is textured to lessen the total surface contact area with the wearer's ears and to also increase friction between the wearer's ears and the inner ear pad to reduce relative motion. Channels 76 are formed between the center section and sides of the inner ear pad at the upper end to aid in ventilation and drainage of perspiration.

The rivet 48, shown in FIG. 5, forms half of a snap fastener on the exterior surface of the cup section to enable a chin strap 76, having the complementary halves 78 of the snap fasteners mounted thereto, to be snapped to the ear guard assembly 10. The chin strap retains the ear guard assembly on the wearer's head. Slot 80 in the center leg 40 of the side panel enables the excess length 82 of the chin strap 76 to be hidden in the ear guard assembly to keep the excess strap away from the opponent's eyes.

After use, the inner ear pads can be removed by hand as shown in FIG. 5 for a thorough cleaning of the ear pads and the side panels 12 and 14. As a result, any accumulation of perspiration as well as bacteria or viruses that have been collected on the ear guard assembly from either the mat or the opponent, can be removed. The ear guard assembly of the present invention thus meets the objective of the present invention to aid in improving hygiene to stop the spread of illnesses among wrestlers.

The side panels, by being molded flat provide a convenient surface for the addition of a team logo or identification as indicated on the right side panel 12 shown in FIG. 1. Since the side panel is initially flat, graphics can be easily printed thereon. This provides an additional advantage of the ear guard assembly of the present invention as compared to ear guards molded with a convex outer surface.

It is to be understood that the invention is not limited to the exact construction illustrated and described above, but that various changes and modifications may be made without departing from the spirit and scope of the invention as defined in the following claims.

I claim:

1. An athletic ear guard assembly for covering and protecting a wearer's ears comprising:

a cup section forming a convex outer surface and a concave inner surface forming a concave cavity;

strap means connected to said cup section for holding said ear guard assembly in position on a wearer's head;

a resilient inner ear pad;

said cup section and said inner ear pad including means for removably mounting said resilient inner ear pad to the concave surface of said cup section so that said ear pad can be readily removed for cleaning said assembly and replaced in said cup section by hand manipulation of said inner ear pad, said means for removably mounting said inner ear pad including a channel along portions of the periphery of said cup section on said concave surface and a flange along corresponding portions of the periphery of said inner ear pad for insertion into said channel to mount said inner ear pad into said concave cavity.

2. An athletic ear guard assembly for covering and protecting a wearer's ears comprising:

a cup section forming a convex outer surface and a concave inner surface forming a concave cavity;

strap means connected to said cup section for holding said ear guard assembly in position on a wearer's head;

a resilient inner ear pad;

said cup section and said inner ear pad including means for removably mounting said resilient inner ear pad to the concave surface of said cup section so that said ear pad can be readily removed for cleaning said assembly and replaced in said cup section by hand manipulation of said inner ear pad; and said cup section being generally triangular in shape with three side edges and said inner ear pad being molded in a flat triangulated shape having two sides in an open appendage form to enable contouring of the flat inner ear pad into the concave cavity of the cup section.

3. The athletic ear guard assembly of claim 2 wherein the inner ear pad forms a pair of channels along an inner surface of said ear pad for passage of air and for drainage of perspiration.

4. The ear guard assembly of claim 2 wherein said cup section is molded of a flat member with a main panel portion and three depending legs extending from said main panel portion in the same direction and further comprising means for coupling the distal ends of said legs together to contour said legs and main panel portion into a cup shape forming said concave cavity.

5. An athletic ear guard assembly for covering a wearer's ears comprising:

left and right side panels each having means forming a cup section having a convex outer surface and a concave inner surface;

strap means for holding said side panels on a wearer's head with the concave inner surface of the cup sections overlying the wearer's ears;

a resilient inner ear pad disposed in each of said cup sections;

said cup sections and said inner ear pads including means for removably mounting said inner ear pads to the concave surface of said cup sections for selective removal and replacement by hand manipulation of said inner ear pads without the use of tools and separate fasteners to clean said inner ear pads and said side panels;

said left and right side panels each being formed by a flat sheet material with a main panel portion and three spaced legs extending from one side of said main panel portion said legs and main panel portion being deflected so that the distal ends of said legs overlay one another and said distal ends being joined together so that said main panel portion and said legs form said cup sections with the spaces between said legs remaining to form openings through the cup sections of said side panels.

6. The athletic ear guard assembly of claim 5 wherein the side panels and strap means are integrally molded as a single flat piece with a pair of straps extending from the cup portion of each side panel, said straps including engagement means for engaging the corresponding straps of the opposite side panel.

7. The athletic ear guard assembly of claim 6 wherein said strap means further includes means for mounting a chain strap to said side panels.

8. The athletic ear guard assembly of claim 7 wherein said chin strap is mounted by a pair of snap fasteners with one half of each snap fastener being riveted to said cup sections.

9. The athletic ear guard assembly of claim 5 wherein said strap means includes an upper and a rear strap integrally formed with said main panel portion, the upper and rear straps of said left side panel having means for engagement with the upper and rear straps respectively of the right side panel for attaching said straps together.

10. The athletic ear guard assembly of claim 5 wherein said inner ear pads are molded in a flat triangulated shape having two sides in an open appendage form enabling said inner ear pads to be contoured into a concave shape for mounting to the concave surface of the cup sections.

11. The athletic ear guard assembly of claim 5 wherein the mounting means includes U-shaped channels integrally formed in the side panels at the periphery of the cup sections along the three sides of the cup sections; and wherein said inner ear pads include corresponding mounting flanges along the periphery of said inner ear pads for insertion into said channels.

12. The athletic ear guard assembly of claim 11 wherein said ear pads are formed with three concave sections outwardly facing with a groove formed on the inner side of said ear pads between the concave sections.

13. The athletic ear guard assembly of claim 12 wherein the interior surface of said inner ear pads is textured.

14. An athletic ear guard assembly for covering and protecting a wearer's ears comprising:

a cup section molded of a flat member with a main panel portion and three depending legs extending from said main panel portion in the same direction and means for coupling the distal ends of said legs together to contour said legs and main panel portion into a cup shape having a convex outer surface and a concave inner surface forming a concave cavity;

strap means connected to said cup section for holding said ear guard assembly in position on a wearer's head; and a resilient inner ear pad disposed in said concave cavity.

15. The athletic ear guard assembly according to claim 14 wherein said cup section is generally triangular in shape with three side edges and said inner ear pad is molded in a flat triangular shape having two sides in an open appendage form to enable contouring of the flat inner ear pad into the concave cavity of the cup section.

16. The athletic ear guard assembly according to claim 15 further comprising:

means for removably mounting said inner ear pad to said cup section so that said inner ear pad can be readily removed for cleaning said assembly and replaced in said cup section by hand manipulation of said inner ear pad.

17. The athletic ear guard assembly according to claim 14 wherein said cup section and said strap means are integrally molded as a single flat piece with a pair of straps extending from said cup section.

* * * * *